United States Patent [19]

Watanabe et al.

[11] 4,113,752

[45] Sep. 12, 1978

[54] METHOD FOR REFINING OF PALM OILS

[75] Inventors: Haruo Watanabe, Ichikawa; Masaaki Negishi, Chiba, both of Japan

[73] Assignee: Showa Sangyo Kabushiki Kaisha, Tokyo, Japan

[21] Appl. No.: 697,192

[22] Filed: Jun. 17, 1976

Related U.S. Application Data

[63] Continuation of Ser. No. 183,057, Sep. 23, 1971, abandoned.

[51] Int. Cl.[2] ..... C11B 3/04

[52] U.S. Cl. ..... 260/424; 260/428

[58] Field of Search ..... 260/420, 424, 428, 419

[56] References Cited

U.S. PATENT DOCUMENTS

| | | | |
|---|---|---|---|
| 1,964,875 | 7/1934 | Freiburg | 260/424 |
| 2,587,954 | 3/1952 | Babayan | 260/424 X |
| 2,602,807 | 8/1952 | Morris et al. | 260/424 X |
| 2,783,260 | 2/1957 | Merker | 260/424 |
| 2,795,543 | 6/1957 | Opie | 260/424 X |
| 3,284,213 | 11/1966 | Van Akkeren | 260/424 X |
| 3,354,188 | 11/1967 | Bock et al. | 260/424 |
| 3,895,042 | 7/1975 | Taylor | 260/424 |

*Primary Examiner*—Winston A. Douglas
*Assistant Examiner*—John F. Niebling
*Attorney, Agent, or Firm*—Holman and Stern

[57] ABSTRACT

This invention relates to a method for the refining of palm type oils such as palm oil and other similar natural oils including palm kernel oil, coconut oil, and the like. The method includes adding a small quantity of phosphoric acid to a crude palm type oil, treating said oil with a small quantity of activated clay, and then subjecting said oil to steam refining of 200° to 270° C. with the blowing of superheated steam into the oil under high vacuum after the activated clay has been removed.

4 Claims, 1 Drawing Figure

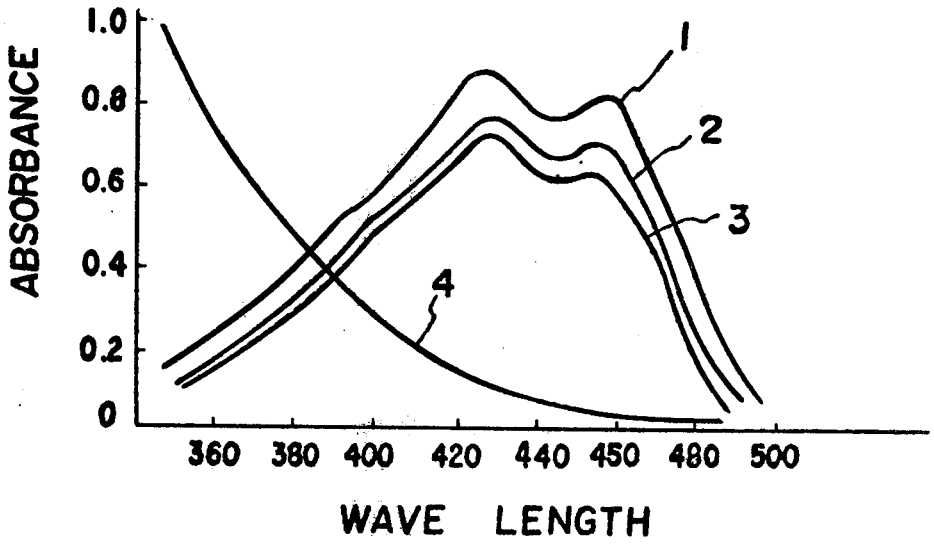
ABSORBANCE
1.0
0.8
0.6
0.4
0.2
0
360
380
400
420
440
450
480
500
WAVE LENGTH
1
2
3
4

METHOD FOR REFINING OF PALM OILS

This is a continuation of application Ser. No. 183,057 filed Sept. 23, 1971, now abandoned.

In previous methods for the refining of palm oils, a steam refining method has been used in addition to the ordinary alkali refining method. The former method is a steam distillation method under high temperature and high vacuum. In the steam distillation method, two refining processes, neutralization and deodorization are carried out at the same time. This method has been found to be a profitable one, since refining losses of neutral oil, such as entrainment in the soapstock and saponification by the alkali, which occur in the alkali refining method, can be eliminated. In the steam distillation method however, a large quantity of absorbent must be employed in the preliminary treatment process, and for this reason, the alkali refining method has been commonly used due to the economic advantages.

A decolorizing process is necessary in all these common methods mentioned above, and in the steam refining method, the crude oil is subjected to a decolorizing process prior to steam distillation. For palm oils, a decoloring process is extremely important because such oils contain a considerable amount of coloring matters derived from raw materials.

Particularly in the case of crude palm oil, it is difficult to decolorize this oil because of the large quantity of carotinoids contained therein.

As a method for decolorizing palm oils, adsorption of the coloring materials by adsorbents, such as activated clay and active carbon, is generally employed. However, it is necessary to employ a large quantity of adsorbent for decolorizing palm oils in proportion to the quantity of coloring matters contained in them, and the refining losses which are caused by entraining neutral oil in the absorbent cannot be avoided. This is a bar to the economical use of the steam refining method for palm oils, in spite of the many advantages which are associated with this method.

In the steam refining method, heat sensitive coloring matters such as carotinoids may be decomposed and decolorized by heat in the course of refining, but this has no effect on other heat insensitive matters. For the above reasons it is impossible to decolorize palm oils completely the steam refining method. Therefore, not only a heat treatment but also treatment by adsorbent cannot be omitted for refining palm oils. Moreover, for complete decoloration of palm oils it is necessary to use a large quantity of adsorbent for decolorizing thoroughly in spite of the fact that there is a loss of neutral oil caused by entrainment.

The inventors of the present invention have studied the refining and other treatments of palm type oils, and invented a new method for refining of these oils, in which crude palm type oils are pretreated with a small quantity of phosphoric acid and then a small quantity of activated clay is mixed with the oil. The oil is subjected to steam refining at 200° to 270° C. under a high vacuum after activated clay has been removed. The inventors of the present invention have discovered that, by the above treatment, palm type oils can be decolorized thoroughly using small quantities of activated clay.

In carrying out the present invention, during the pre-treatment which is carried out before steam refining of the crude palm type oils, a small quantity of phosphoric acid is added to the melted crude palm oils and thoroughly mixed by agitation. Then a small quantity of activated clay is added while elevating the temperature of the oil, and the temperature of the oil is maintained at around 100° C., for a certain period. Although there is no limitation for this period, it is usually selected within a range of about 5 to 30 minutes. Then, the activated clay is removed, and the resultant color of the oil is almost the same as that of the crude oil in spite of the above treatment having been carried out. Finally, decolorization, deodorization and deacidification are carried out at the same time by subjecting the above mentioned oil to a steam refining process with the blowing of super heated steam into the oil under high vacuum at above 200° C. A thoroughly light coloured and odourless oil can then be obtained.

Although the pre-treatment of the present invention looks like a decolorizing process that is made before a conventional steam refining method, there are substantial differences. In the conventional method, the color of the oil is removed by treatment with an adsorbent such as clay, contrary to the pre-treatment of the present invention in which the color of the oil is not removed by activated clay treatment and is the same as the color of the crude oil, in short, decolorization does not take place in the pre-treatment of the present invention. This can be understood more clearly from the visible absorption spectrum shown in the FIGURE. The pre-treated palm oil in the method of the present invention which has been treated with phosphoric acid and activated clay 3 and the untreated crude palm oil 2 have a peak of absorption, which originates from the presence of $\beta$-carotine, at the same wave length as that of the absorption of $\beta$-carotine 1. This indicates that it is not in the pre-treated palm oil that the decolorization takes place. On the other hand, palm oil which has been treated only with activated clay by conventional method 4 has no absorption peak corresponding to $\beta$-carotine, and the height of the absorption curve is smaller, these facts showing that the oil has been decolorized. In the present invention, decoloration is carried out substantially in the steam distillation process following the pre-treatment. Thus the oil is thoroughly decolorized by the same distillation. This is one of the characteristics of the present invention, and offers a quite new idea for the refining process of oils, by which neutralization, bleaching, and deodorization of palm type can be accomplished in one operation involving steam distillation.

If the use of phosphoric acid is omitted in the pre-treatment process of the present invention, the process becomes similar to a conventional decolorizing process and an extremely low decolorizing effect is attained by the subsequent steam refining process, which is carried out after the treatment with activated clay, though the oil is decolorized to some extent. In this case, to obtain a final product decolorized to the extent of palm oil which has been treated by phosphoric acid and activated clay it is necessary to use more than twice the amount of activated clay than that used in the present invention. In addition, the temperature must be kept higher than in the case of the present invention.

The amount of phosphoric acid used in the pre-treatment process of the present invention has no specific limitation but depends upon the properties of the crude palm type oils to be used. The amount is however, generally within about 0.01 to 2.0 percent of the oil. The same effect is achieved even if more than 2.0 percent of phosphoric acid is used, but from an economical point of view, it is sufficient to use phosphoric acid in the amount of from 0.02 to 1.0 percent of the crude palm oil.

The amount of activated clay used in the pre-treatment process is also variable depending upon the properties of the crude oils to be used. It is sufficient to use about one half the amount or less of that used in conventional decolorizing process.

It has been known to use phosphoric acid in refining processes of oils. In these methods, however, phosphoric acid is always used with an alkali in alkali refining methods, reacting with phosphatides in the oil, and reducing the loss of neutral oil entrained in soapstock in the course of the neutralization process.

It cannot be explained clearly as to the mechanisms of the effect of phosphoric acid used in the present invention comprising a method for refining of palm type oils which scarcely contain any phosphatide. It is clear that the mechanisms and action of phosphoric acid used in the present invention, in which alkalis are not used, are quite different from conventional alkali refining processes, using phosphoric acid with alkalis. And also, the method of the present invention is superior to conventional alkali refining methods in that it results in little loss of neutral oil and greater effect of decoloration.

The refining method of the present invention is the most economical one because of the absence of complicated operation and special facilities, the low adsorption loss of neutral oil, and the fact that oil of good quality can be obtained easily.

EXAMPLE 1

The following four refining methods were applied to a Sumatra grown crude palm oil having acid value of 6.35.

(1) Phosphoric acid-activated clay treatment and steam refining. (the method of the present invention)

Phosphoric acid of 85% is added 0.05% to the crude oil with mixed for 30 minutes. Then, 3% of activated clay was added to them, heated up to 105° C., with continual mixing for 15 minutes, and then activated clay was removed. The oil thus obtained was subjected to steam refining with the blowing of super heated steam into it under vacuum (5mm Hg absolute) at 270° C., for 30 minutes, using conventional deodorization apparatus.

(2) Activated clay treatment with steam refining (without the use of phosphoric acid). A control method for comparison with the present invention.

Two crude oils were decolorized by a conventional decolorizing method with 3% of activated clay, one at 105° C., and the other at 150° C., for 15 minutes. After clay was removed, the oils were subjected to steam refining under the same conditions as described in (1).

(3) The crude oil was treated simultaneously with phosphoric acid and activated clay, and was steam refined. (Another control method)

Phosphoric acid of 0.05% and activated clay of 3% were added simultaneously into the crude oil and mixed for 15 minutes at 105° C. After clay was removed, the oil was subjected to steam refining under the same conditions as described in (1).

(4) Alkali neutralization, decoloration and deodorization. (Another control method)

The crude oil was neutralized with the alkali of 14° Be. and the neutralized oil is subjected to decoloration with activated clay in an amount of 3% at 105° C. for 15 minutes. After clay was removed, the oil was subjected to steam refining under the same conditions as described in (1).

The resultant oils obtained from these four methods were measured for colors with a Lovibond 5¼ inch cell. The results are shown in Table 1.

Table 1

| refining methods | Decolorizing effect according to the methods: Color of the product, Yellow | Red | yield (%) (to crude oil) |
|---|---|---|---|
| (1) | 10 | 1.0 | 94.1 |
| (2) Decolorized at 105° C | 20 | 2.3 | 94.1 |
| 150° C | 15 | 1.5 | 94.1 |
| (3) | 10 | 1.5 | 94.1 |
| (4) | 10 | 1.2 | 92.0 |

It is clear that the method of the present invention (1) is superior to the methods (2) and (3), and to the alkali refining method (4) in its decolorizing effect and the small loss of neutral oil.

EXAMPLE 2

0.20% Of phosphoric acid was added to a crude coconut oil having acid value of 9.64, mixed for 10 minutes, the temperature increased to 105° C. and there was added 1% of activated clay, and the operation continued as described in Example 1 (1). After the clay was removed, the oil was subjected to steam refining at 230° C. for 30 minutes. The color of the resultant oil was Yellow 8, and Red 1.5 by Lovibond Tintmeter.

Another control product was obtained by pre-treatment with only 1% clay (105° C., 15 minutes) and carrying out the same steam refining method. This product had the color of Yellow 14, and Red 2.7. To obtain the product with the same color as the former product, it was necessary to use 3% of activated clay, and a 1.6% reduction in the yield resulted.

As described above, it is clear that the method of the present invention provides a remarkable decolorizing effect, and it also has such advantages as a reduction in the quantity of activated clay to be used, and the improvement of the yield.

What we claim:

1. A method for the refining of palm-type oils which consists essentially of adding 0.01 to 2.0% by weight of phosphoric acid to a liquid, substantially phosphatide-free crude palm-type oil in which carotinoids remain substantially in a heat sensitive condition, followed by mixing, adding activated clay to the resultant mixture while increasing the temperature of the mixture to around 100° C., maintaining the mixture at a temperature of about 100° C. for about 5 to 30 minutes, separating the clay from the oil and subjecting the oil to decolorization by steam distillation at a temperature of 200°-270° C. while blowing superheated steam into the oil.

2. The method according to claim 1, wherein the palm type oil is palm oil.

3. The method according to claim 1, wherein the palm type oil is palm kernel oil.

4. The method according to claim 1, wherein the palm type oil is coconut oil.

* * * * *